US008319132B2

(12) United States Patent
Buettner et al.

(10) Patent No.: US 8,319,132 B2
(45) Date of Patent: Nov. 27, 2012

(54) LOAD-BREAK SWITCH

(75) Inventors: Alex Buettner, Roedental (DE); Andreas Hetenyi, Lautertal (DE)

(73) Assignee: Woehner GmbH & Co. KG Elektrotechnische Systeme, Rodental (DE)

( * ) Notice: Subject to any disclaimer, the term of this patent is extended or adjusted under 35 U.S.C. 154(b) by 301 days.

(21) Appl. No.: 12/677,334

(22) PCT Filed: Jul. 25, 2008

(86) PCT No.: PCT/EP2008/059803

§ 371 (c)(1), (2), (4) Date: Apr. 19, 2010

(87) PCT Pub. No.: WO2009/033875

PCT Pub. Date: Mar. 19, 2009

(65) Prior Publication Data

US 2010/0206706 A1 Aug. 19, 2010

(30) Foreign Application Priority Data

Sep. 11, 2007 (DE) ..... 10 2007 043 133

(51) Int. Cl.
*H01H 5/00* (2006.01)

(52) U.S. Cl. ..... 200/400

(58) Field of Classification Search ..... 200/400, 200/50.07, 50.15, 443, 458, 50.12, 50.01–50.03, 200/50.28, 283, 254, 293, 401, 306, 333
See application file for complete search history.

(56) References Cited

U.S. PATENT DOCUMENTS

| | | | | |
|---|---|---|---|---|
| 2,863,016 | A | 12/1958 | Hercules | 200/67 |
| 4,305,610 | A | 12/1981 | Piteo, Jr. et al. | 292/152 |
| 5,322,982 | A * | 6/1994 | Leger et al. | 200/401 |
| 5,746,306 | A * | 5/1998 | Cassity et al. | 200/283 |
| 7,405,369 | B2 * | 7/2008 | Mukharzi et al. | 200/50.03 |

FOREIGN PATENT DOCUMENTS

| | | |
|---|---|---|
| DE | 9203226 | 4/1992 |
| DE | 9101973 | 6/1992 |
| DE | 4102143 | 8/1992 |
| DE | 4207156 | 9/1992 |
| DE | 10055035 | 9/1992 |
| EP | 0418206 | 9/1990 |
| EP | 0547928 | 6/1993 |
| WO | WO 2009033875 | 3/2009 |

* cited by examiner

*Primary Examiner* — Edwin A. Leon
(74) *Attorney, Agent, or Firm* — Westman, Champlin & Kelly, P.A.

(57) ABSTRACT

A load interrupter, especially to be mounted on a busbar includes a housing and a cover that is hinged thereto, a snap switch mechanism for establishing or interrupting an electrical connection between corresponding contacts. A control lever for switching between a current-carrying operation and a current interrupting operation, and a control mechanism which, depending on the position of the control lever, releases or blocks a release element for a displacement. The release element being coupled to a locking device which is arranged in such a manner that it can be engaged with or disengaged from the cover.

11 Claims, 10 Drawing Sheets

LOAD-BREAK SWITCH

CROSS-REFERENCE TO RELATED APPLICATION

This Application is a Section 371 National Stage Application of International Application No. PCT/EP2008/059803, filed Jul. 25, 2008 and published as WO 2009/033875 on Mar. 19, 2009, in German, the contents of which are hereby incorporated by reference in their entirety.

BACKGROUND OF THE INVENTION

The invention relates to a load-break switch, in particular for mounting on busbars. Previously available load-break switches have for the most part been constructed according to the modular design principle. If snap switch mechanisms are present, they are located at the sides of the load-break switch or between the fuses. In this case, rotary handles are used to actuate the snap switch mechanisms.

SUMMARY OF THE INVENTION

The object of the invention is to provide a load-break switch of the type mentioned above which allows a reliable and simple actuation by the operator.

The invention provides a load-break switch for the assembly on busbars, the load-break switch comprising a housing and a cover arranged pivotally thereon; a snap switch mechanism to trigger or to interrupt an electrical connection between associated contacts; an actuating lever for switching between a current operation and a current interruption operation; a locking device which can engage or disengage the cover; a release element being coupled to the locking device; wherein a control mechanism is provided, which, as a function of the position of the actuating lever, frees or blocks the movement of a release element for a movement, wherein the control mechanism comprises a control element and a blocking element, the position of the control element being determined by an adjustment of the snap switch mechanism and the control element controlling the position of the blocking element, thereby making it possible to displace the blocking element into or out of engagement with the release element.

Further embodiments of the load-break switch according to the invention are provided in the subclaims.

The invention provides a load-break switch which is configured for use with fuse elements or without fuse elements and which in particular contains a single lever which is provided for switching the load-break switch between current interruption operation and current operation as well as for opening the cover. The actuating lever is preferably provided in the form of a tilt lever and while it is positioned between currentless operation and current operation, it acts on a snap switch mechanism which in turn is connected to a control mechanism, which serves to produce a blocking or opening of the cover. The blocking of the cover is performed automatically in each case, while to open the cover in the position of the actuating lever in which the opening of the cover is to be possible, a release element has to be actuated to free the cover in order for it to open.

The load-break switch according to the invention is characterised in that a single actuating lever or tilt lever is provided which is used to open the cover for access to connections or fuse elements during currentless operation, while the actuating lever is used when the cover is closed to move the load-break switch into current operation while simultaneously activating an internal snap switch mechanism which in turn ensures a secure locking of the cover via the control mechanism.

In the following, the load-break switch according to the invention will be described with reference to the drawings for illustrating further features. In the drawings:

DETAILED DESCRIPTION OF ILLUSTRATIVE EMBODIMENTS

Figure 1:
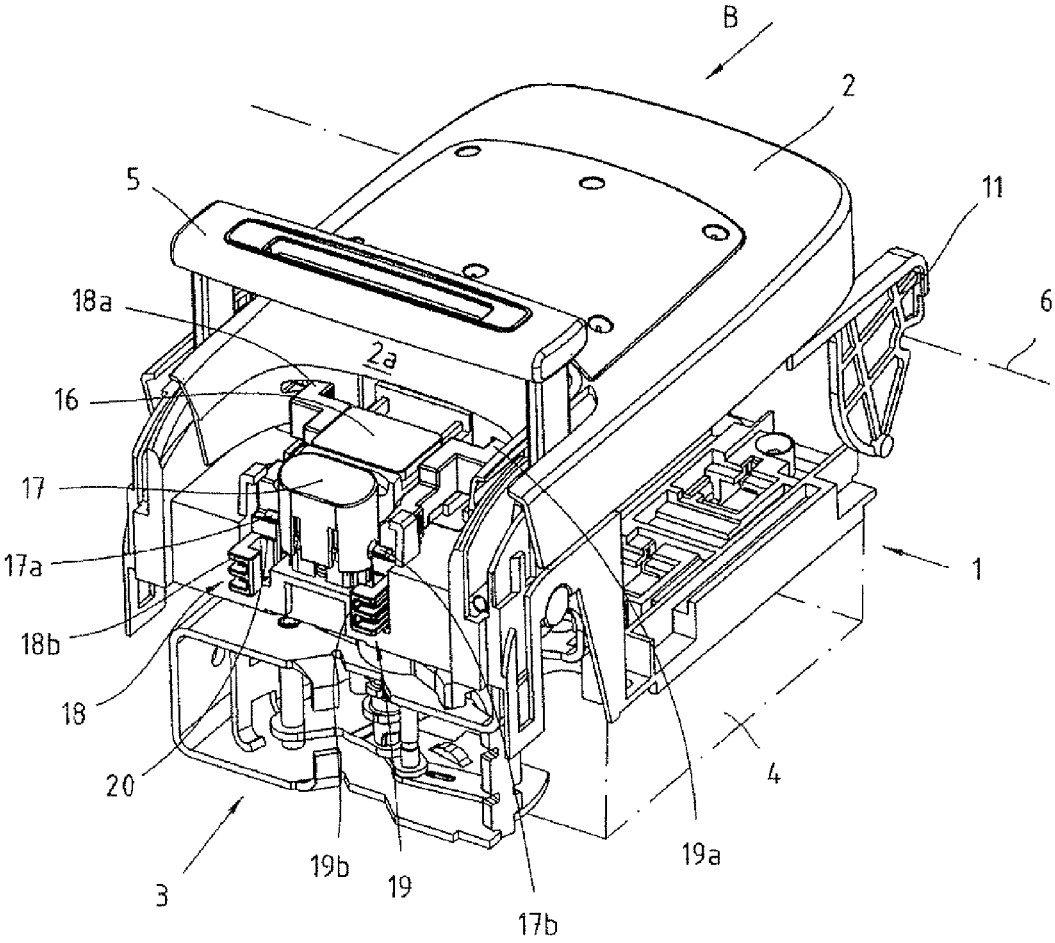
FIG. 1 is a perspective view of the load-break switch according to the invention in a disconnected state, the basic housing being partially removed.

In FIG. 1, parts of the housing have been cut away to provide a clearer view of the individual elements. The load-break switch has a housing 1, on the upper side of which a cover 2 is fitted pivotally, and also has a snap switch mechanism 3 configured in the housing 1. An adapter unit 4 can also be provided which is located under the housing 1 and serves to produce an electrical connection between the poles of the load-break switch on one side and the poles of the busbar unit (not shown) on the other side. The adapter unit 4 is merely indicated in dashed lines.

Furthermore, the load-break switch has an actuating lever 5 which can preferably be moved between two positions. In the position shown in FIG. 1, the actuating lever 5 is in the disconnection position, in other words in an operating position which corresponds to an interruption in the current. The snap switch mechanism 3 which is provided in the housing 1 and has a number of contacts corresponding to the poles is adjusted such that the contacts are not electrically connected to counter-contacts or contact blades. In the position shown in FIG. 1, the actuating lever 5 is in a vertical position with respect to its plane of attachment. In this position and in the situation shown in FIG. 1, the cover 2 is locked, as will be described further below.

As also emerges from FIG. 1, the cover 2 is mounted such that it can pivot about a pivot axis 6, said pivot axis 6 being established by limbs 11 which are either integrated with the cover 2 or are attached separately to the cover 2. It is further provided that the actuating lever 5 is moved together with the cover 2 about the pivot axis 6 when the cover 2 is freed after a corresponding unlocking action.

Figure 2:
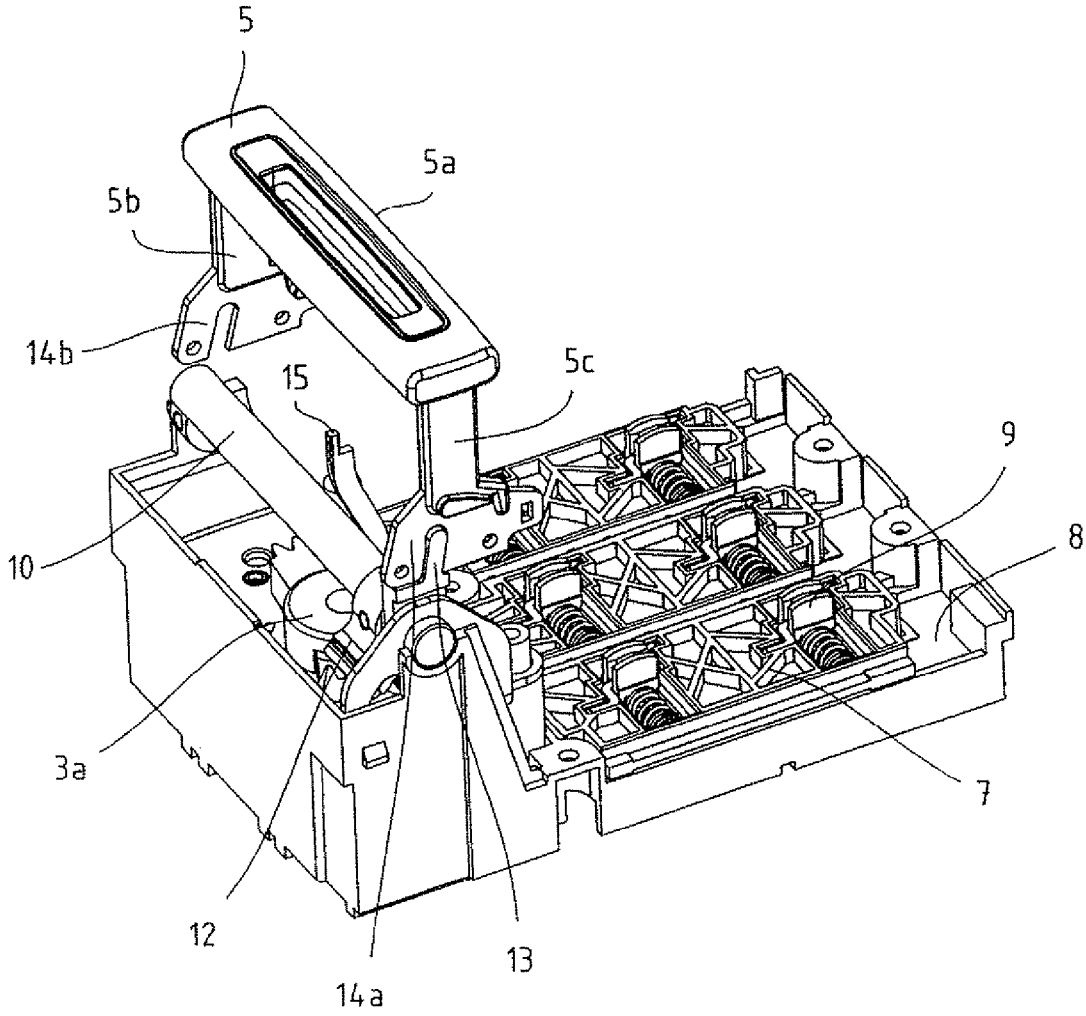
FIG. 2 is a view corresponding to that of FIG. 1 without a cover.

FIG. 2 shows a perspective view of part of the load-break switch with the cover 2 having been removed, thus revealing a switch slide 7 which can be moved along the housing base, denoted by reference numeral 8, due to the switching effect of the snap switch mechanism 3. Located on the switch slide 7 is a plurality of contact elements 9, of which only one is shown. The counter-contact elements or contact blades are not shown in FIG. 2. The counter-contact elements or contact blades, with which the contact elements 9 arranged on the switch slide 7 can be brought into electrical contact, are positioned in a fixed arrangement in the housing, as is known per se.

As can be seen in FIG. 2, the actuating lever 5 is in a mechanical connection with a coupling shaft 10 which preferably supports a spur wheel 12 in the illustrated embodiment. Furthermore, provided on the coupling shaft 10 is a respective latch 13, of which only the latch in a mechanical connection with the arm portion 14*a* is shown. The opposing arm portion 14*b* of the actuating lever 5 is attached to a corresponding latch which is not shown for the sake of clarity. The connection between the actuating lever 5 on the one hand and the latches 13 on the other hand is provided to be detachable in order to be able to pivot the cover 2 together with the actuating lever 5 clockwise about a pivot axis 6 to open the cover, as described further below.

Shown below the coupling shaft 10 is part of the snap switch mechanism 3 which is denoted in FIG. 2 by reference numeral 3*a* and contains an outer toothed portion 3*a*. Furthermore, FIG. 2 shows an element 15 of a blocking mechanism which will be described later on, said element 15 being a control element, preferably in the form of a finger which can be moved by the snap switch mechanism 3, as will also be described in detail. The switch slide 7 is in the disconnected state position according to FIG. 2 in which state there is an interruption in the current between the associated contacts. According to FIG. 2, the switch slide 7 has three portions, in other words the load-break switch is configured on three poles.

The following description depicts in detail the blocking mechanism which produces a blocking of the cover 2 such that the actuating lever 5 can be moved from the position shown in FIG. 1 into a position which will be explained with reference to FIG. 3.

Figure 3:
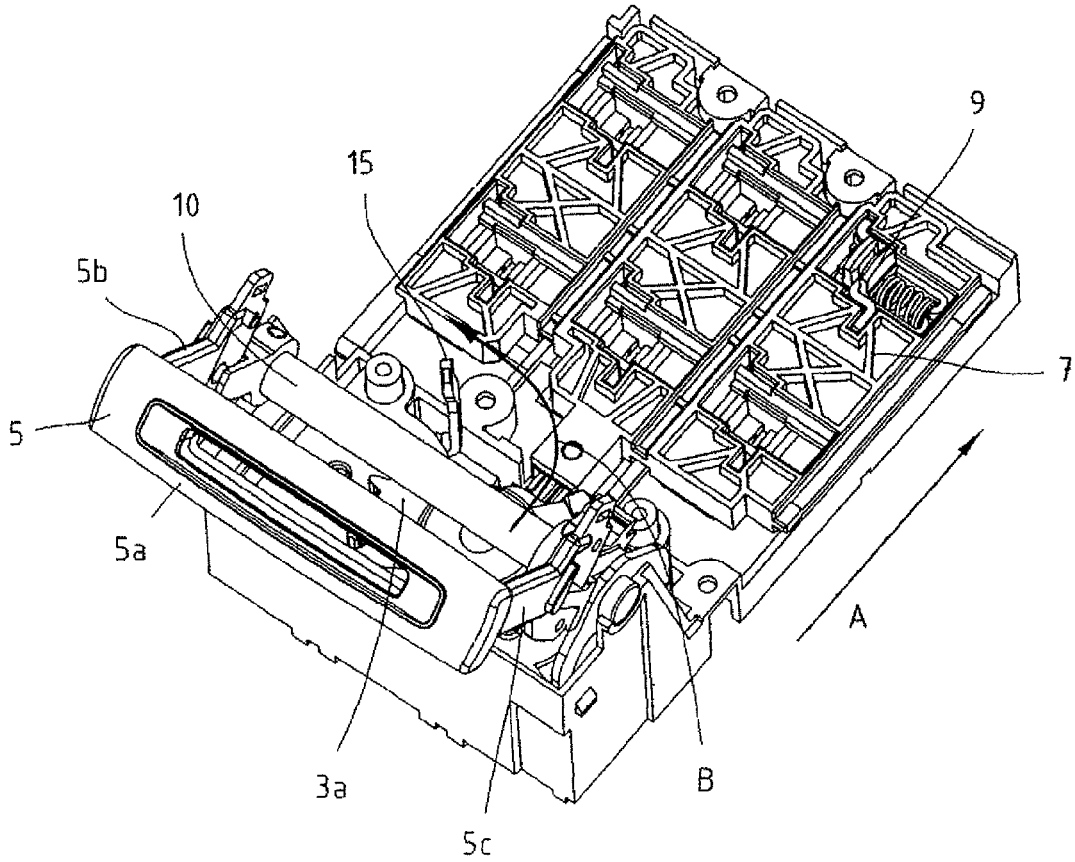
FIG. 3 is a perspective view of the load-break switch without a cover in a connected state.
Figure 4:
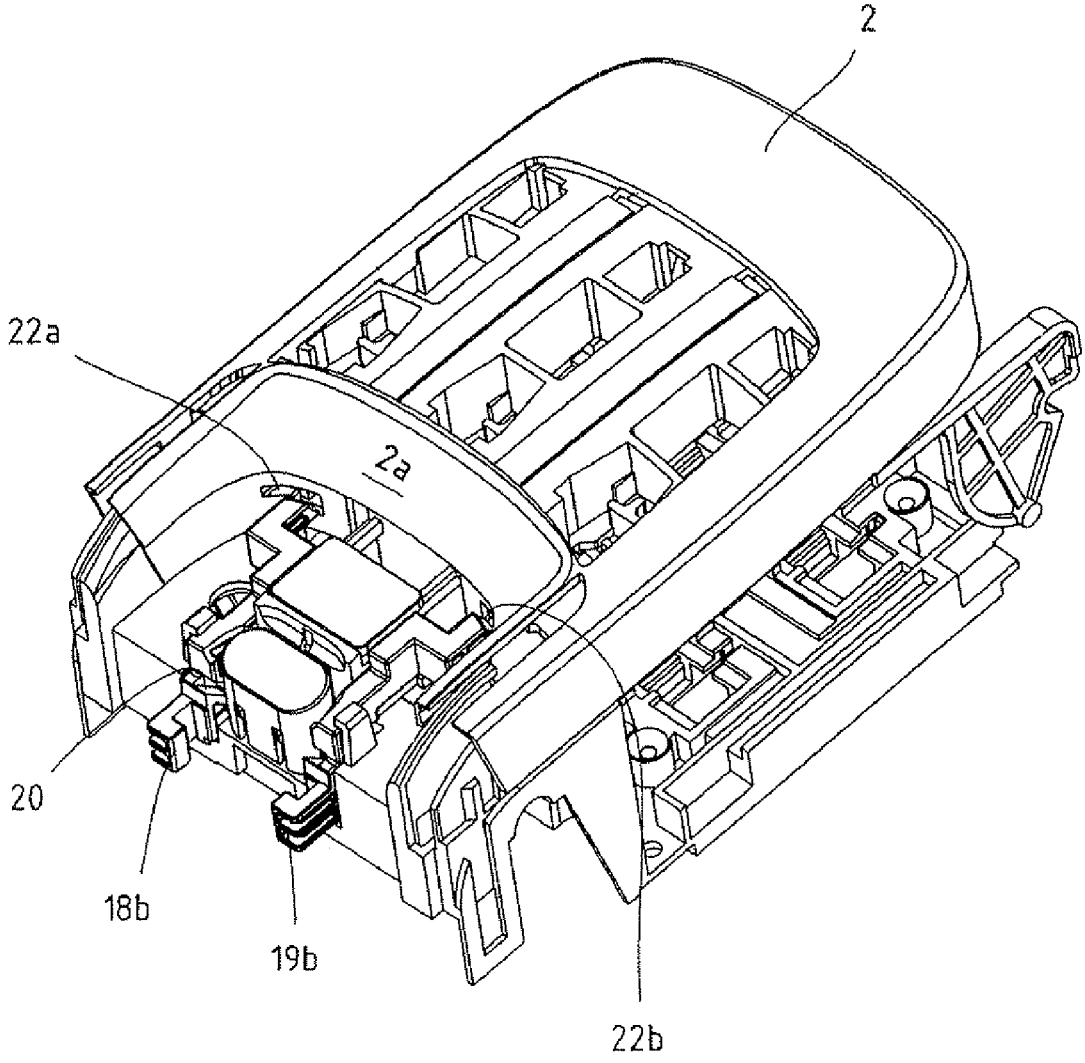
FIG. 4 is a perspective view of part of the load-break switch.
Figure 5:
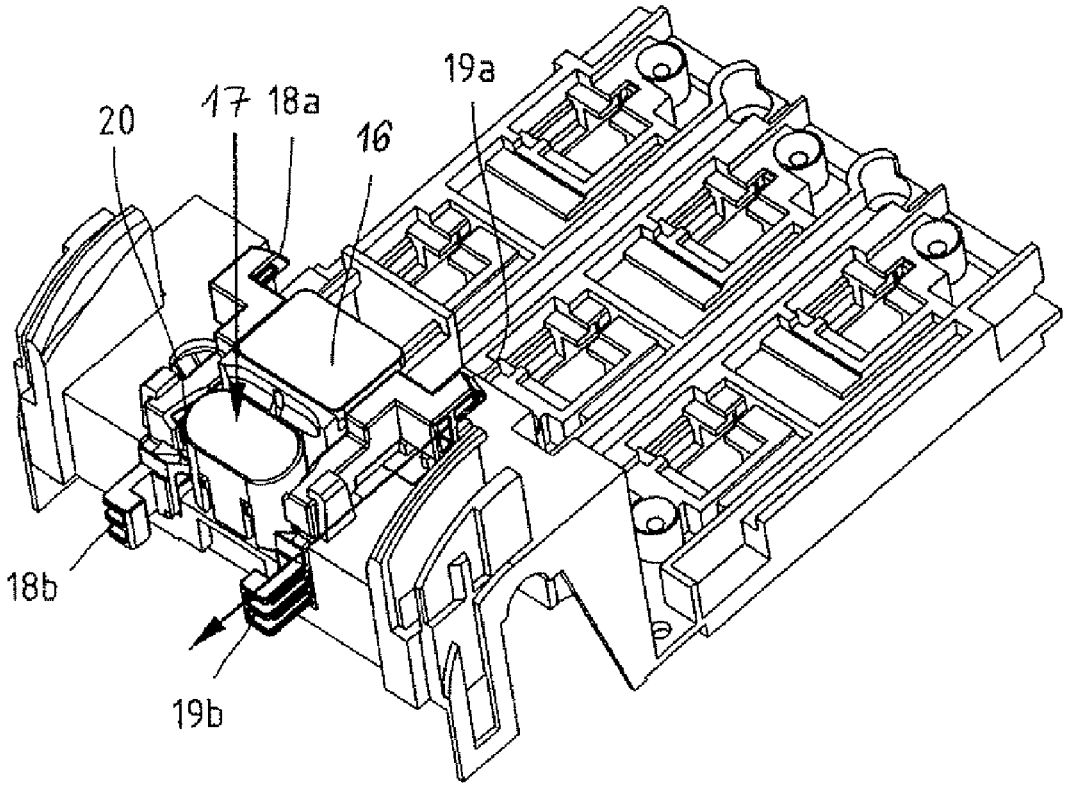
FIG. 5 is a partial illustration to show the locking device in a state in which the cover can be opened.

FIG. 3 is a perspective view of the load-break switch with the cover having been removed to illustrate the position of the switch slide 7. The actuating lever 5 has been displaced by an angle of, for example, 50° from the vertical position according to FIG. 1. During the pivoting movement of the actuating lever 5 into the position shown in FIG. 3, the snap switch mechanism 3 is triggered and the switch slide 7 moves into the position shown in FIG. 3 in which the switch slide 7 is displaced according to arrow A such that all the contacts 9 engage with the associated contact blades on the housing, so that the load-break switch is in current operation. Moving the actuating lever 5 also activates the blocking mechanism, such that the control element 15 moved directly by the snap switch mechanism 3 preferably performs a rotational movement, as shown by arrow B in FIG. 3, in order to bring a preferably plate-shaped blocking element 16 into a locking position, as a result of which a release element 17 (FIG. 1) is locked against any movement. The rotational movement of the control element 15 is indicated in FIG. 3 by arrow B. Instead of a rotational movement, a cam sequential phase control can also be provided or another transmission of the type of movement of the switch slide 7 to the blocking element 16 which will be described in more detail. This movement of the control element 15 produces a frictional connection with the actuating lever 5 via the coupling shaft 10, the control element 15, the blocking element 16 up to the release element 17. In this procedure, the blocking element 16 blocks a movement of the release element in the direction of an arrow shown at the bottom of the arrangement in FIG. 5 by means which will be described later on. FIG. 4 shows a view corresponding to that of FIG. 1 without an actuating lever 5, the cover 2 being unlocked according to FIG. 4, while FIG. 5 depicts details of the blocking mechanism and of the release element 17 as well as of the plate-shaped blocking element 16.

In the position according to FIGS. 1 and 2, the load-break switch is in the following state:

A locking device 18, 19 which, in the illustrated embodiment, consists of two arms 18, 19, engages with its trailing ends 18*a*, 19*a* into openings or slots 22*a*, 22*b* in the freely movable end of the cover 2 in the region of a downwardly extending front wall 2*a*, as a result of which the cover 2 is locked in the position shown in FIG. 1. According to FIG. 1, the locking arms 18, 19 extend laterally past the blocking element 16 and the release element 17 and define leading ends 18*b*, 19*b* which project over a front wall 20 of the load-break switch. The locking device 18, 19 is part of the blocking mechanism mentioned above. In the position shown in FIG. 1, the release element 17 which is preferably under the initial tension of a spring (not shown in FIG. 1) is in a raised position and supports lateral projecting pegs 17*a*, 17*b*. These pins or pegs 17*a*, 17*b* can be brought into contact with an oblique surface which, according to FIGS. 4 and 5, are from the end face 20 slightly downwards and behind and are part of the locking arms 18, 19. These oblique surfaces are denoted in FIGS. 4 and 5 by reference numeral 21. Said oblique surfaces form an obliquely running groove in the locking arms 18, 19, as a result of which the pegs 17*a*, 17*b* produce a corresponding displacement of the locking arms 18, 19 either in the direction of arrow B or opposite the direction of arrow B during the upwards or downwards movement of the release element 17, i.e. in the illustrated embodiment, the locking arms 18, 19 are moved in the direction of arrow B when the release element is pressed downwards, whereas when the release element 17 is moved upwards, for example under the effect of a spring which will be described later on, the locking arms 18, 19 are moved in a direction opposite that of arrow B.

The locking arms 18, 19 as well as the blocking element 16 are guided by guide elements (not shown) such that the movement which is desired in each case can be performed in a precise manner.

The function of the locking arms 18, 19 is to block the cover 2 either in the position shown in FIG. 1 or to free said cover for it to open, in that said locking arms 18, 19 are removed from the openings or slots, denoted by reference numerals 22*a*, 22*b* in FIG. 4, of the cover 2. The two locking arms 18, 19 which extend preferably in a mutually mirror-symmetrical manner are moved in that the release element 17, preferably in the form of a pushbutton, is moved downwards against the spring 27 shown in FIG. 1, as a result of which the lateral pegs 17*a*, 17*b* run along the grooves formed by oblique surfaces 21 and thus shift the two locking arms towards the front wall 20.

A precondition for the displacement of the locking arms 18, 19 to free the cover 2 is that the actuating lever 5 adopts the position shown in FIG. 1 in which the snap switch mechanism 3 holds the switch slide 7 in the position shown in FIG. 2, in other words in the currentless position of the load-break switch (disconnected state) and at the same time the control element 15 is in a position shown in FIG. 2 in which the blocking element 16 in turn adopts a predetermined position shown in FIG. 1 in which the blocking element 16 frees the movement of the release element 17 downwards in a manner to be described further below. As mentioned, it is a precondition for a possible downwards movement of the release element 17 to displace the locking arms 18, 19 by means of the pegs 17*a*, 17*h* that the blocking element 16 frees the release element which, in turn, is achieved in that the control element 15 holds the blocking element 16 in a release position for the release element 17. During this procedure, the control element 15 is held in the position shown in FIG. 2 by the snap switch mechanism 3.

FIG. 5 shows the locking arms 18, 19 in the forwards displaced position in which the ends 18*a*, 19*a* of the arms are removed from the slots 22*a*, 22*b* in the cover 2 and the cover 2 is freed for an opening movement about the axis 6.

Figure 6:
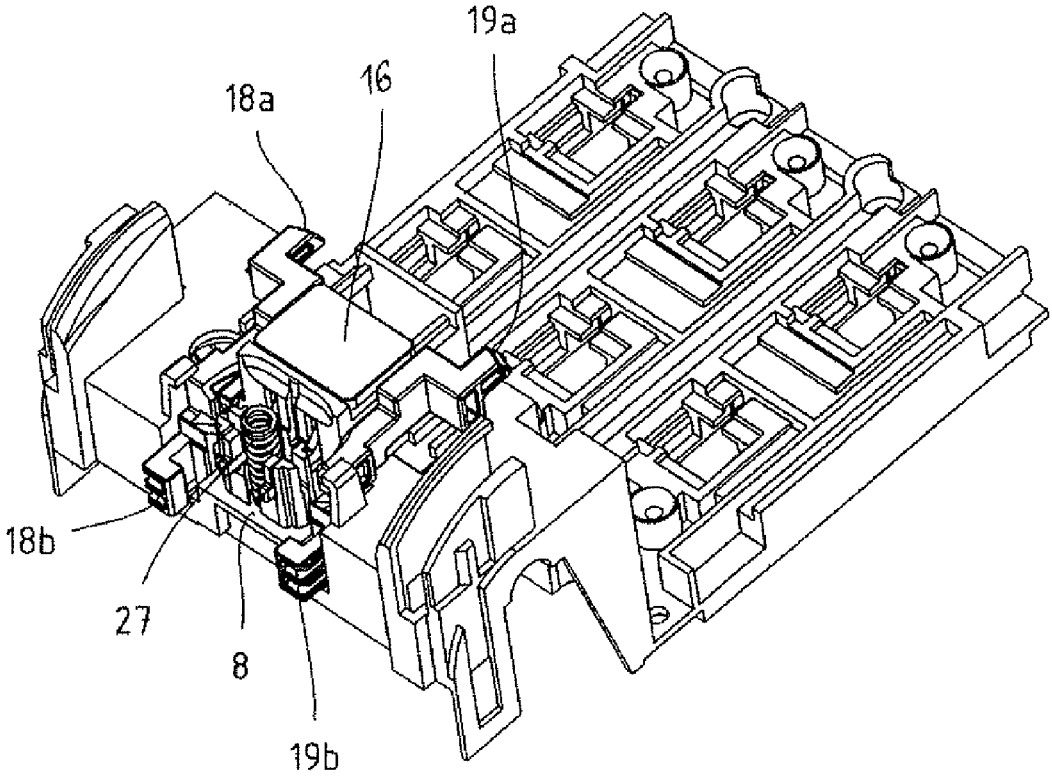
FIG. 6 is a view corresponding to that of FIG. 5 to show the locking device in the state in which said locking device holds the cover which is not shown.

FIG. 6 shows a view corresponding to that of FIG. 5, in which the locking arms 18, 19 keep their blocking position with respect to the cover 2, FIG. 6 showing a compression spring 27 which presses the release element 17 upwards and is inserted between the release element 17 and the base 8 of the housing. The position of the locking arms 18, 19 according to FIG. 5 corresponds to the view according to FIG. 4.

Figure 7:
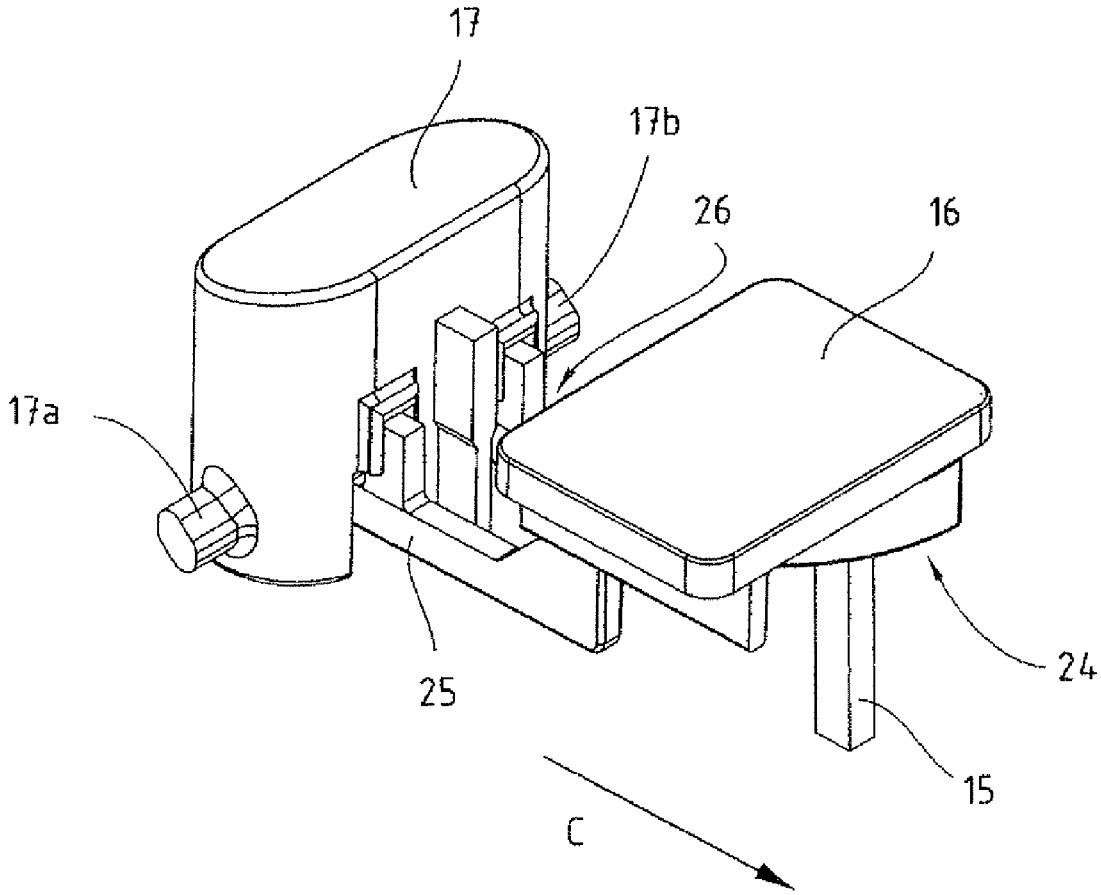
FIG. 7 is a component drawing of the release device and of the blocking element for the release device.
Figure 8:
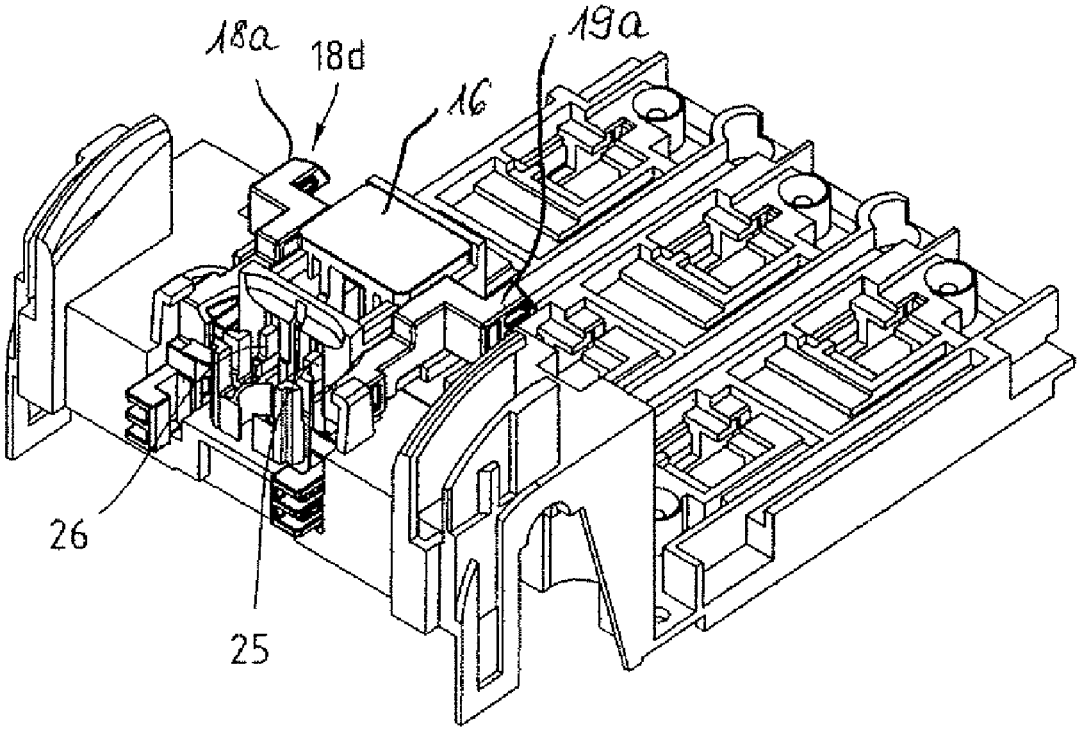
FIG. 8 shows a detail of the locking device with blocking element.

FIGS. 7 and 8 show further details of the release element 17, the blocking element 16 and the control element 15. As mentioned, the position of the control element 15 is established by the respective position of the snap switch mechanism 3, the control element 15 being oriented on a control curve or guide path 24 which is defined on the lower side of the blocking element 16. In the illustrated embodiment according to FIGS. 7 and 8, the blocking element 16 preferably has two arm-shaped members 25, 26 which are braced laterally from the blocking element 16 towards the release element 17 which is preferably in the form of a pushbutton. The arms 25, 26, together with the blocking element 16, can be displaced in the direction of arrow C and in a direction opposite that of arrow C respectively, the displacement being produced by the movement of the control element 15.

In the position shown in FIG. 7, the arms 25, 26 engage under the release element 17 and block said release element against a downwards movement. On the other hand, if the arms 25, 26, together with the blocking element 16, are removed from the release element 17 due to a movement of the control element 15 in the direction of arrow C, the release element 17 can be moved downwards in order to move the locking arms 18, 19 beyond the front wall 20 by means of the laterally projecting pegs 17*a*, 17*b* and by the contact thereof with the lateral grooves established by oblique surfaces 21, 22 of the locking arms 18, 19.

Figure 9A:
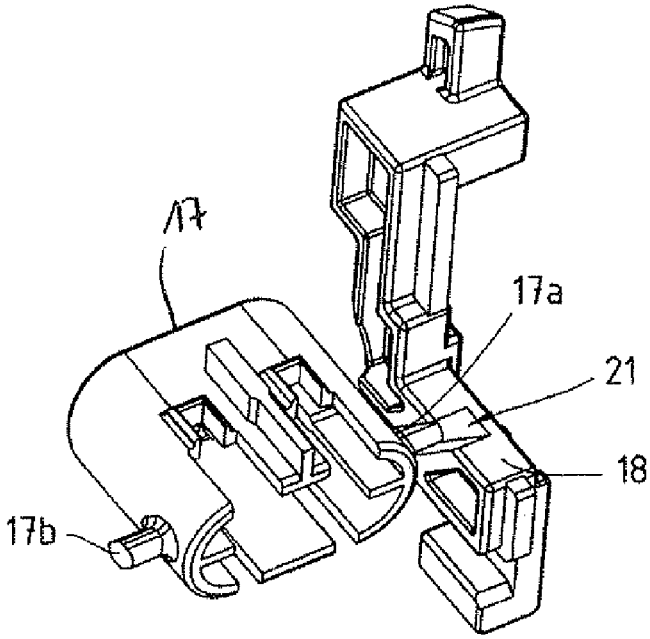
FIG. 9*a* shows part of the release element with a locking arm.
Figure 9B:
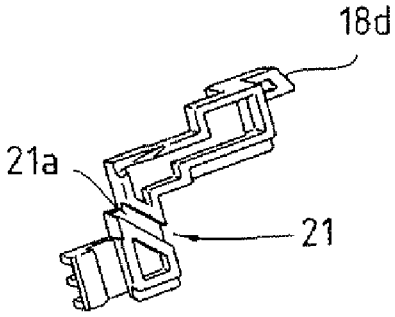
FIG. 9*b* shows part of a locking arm.

FIGS. 9*a* and 9*b* schematically show the release element 17 and one of the locking arms 18, 19 as well as an oblique surface 21 configured in the locking arm 18 or 19. Strictly speaking, two mutually parallel oblique surfaces 21 are provided in each case which respectively produce an obliquely running groove 21*a*, as can be seen in FIGS. 9*a* and 9*h*.

The arms 18, 19 simultaneously form thereby a guidance for the release element 17 or for the laterally projecting pegs 17*a*, 17*b* thereof with the result that when the release element 17 moves downwards, the locking arms 18, 19 in FIG. 1 are moved in the direction of arrow B and when the release element 17 moves upwards due to the effect of the spring 27, locking arms 18, 19 are moved in a direction opposite that of arrow B and into the blocking position for the cover 2. Thus, the locking arms are moved from the release position for the cover 2 into the blocking position due to the effect of the spring 27. Furthermore, in the illustrated embodiment, in the position of the actuating lever 5 according to FIG. 1 in order to open the cover 2 it is necessary for the release element 17 to be actuated, i.e. pressed downwards, and for the cover 2 to be rotated about the axis 6 so that it can open as long as the release element 17 has been displaced downwards. At the moment when the release element 17 is freed, it is moved upwards by the effect of the spring 27 with the simultaneous displacement of the locking arms 18, 19 against the direction of arrow B in FIG. 1 and into the position shown in FIG. 6.

As further emerges from FIGS. 8 and 9*b*, the locking arms 18, 19 are bevelled in the region of their end portions 18*a*, 19*a*, as shown in FIG. 9*b* by reference numeral 18*d*, and the same also applies to the locking arm 19. Due to this bevel, when the cover 2 is being closed, the front edge, lying underneath on the end face 2*a*, of the cover impacts against the oblique surfaces of the two locking arms 18, 19, thereby pushing the locking arms 18, 19 in the direction of arrow B until the cover reaches its end seat and the ends 18*a*, 19*a* of the locking arms 18, 19 are again able to engage in the openings 22*a*, 22*b* in the cover so that it can be locked.

When the actuating lever 5 has moved from the vertical position according to FIG. 1 into the position according to FIG. 3 which is pivoted by 50 degrees, for example, the control element 15 is in the position in which it holds the blocking element 16 in the position shown in FIG. 7 and thus stops the release element 17 from moving downwards via the arms 25, 26. At the same time, the locking arms 18, 19 are in the position shown in FIG. 1, thereby preventing the cover 2 from opening.

The preceding description reveals that the load-break switch can be moved from currentless operation (FIG. 1) into connected operation by a single actuating lever 5 which can be pivoted about an axis 6 which is parallel to the closed position of the cover. However, to open the cover 2, it is necessary for the release element 17 to also be actuated, which can only be achieved when the actuating lever 5 occupies the vertical position shown in FIG. 1. In this position, the snap switch mechanism 3 is in the untriggered state in which an interruption in the current is ensured by the corresponding position of the switch slide 7 and in which the control element 15 frees the release element 17 for a downwards movement by its mechanical coupling with the release element 17. In this position, the blocking mechanism is adjusted such that the blocking element 16 does not stop the release element 17, preferably in the form of a pushbutton, from moving downwards.

In order to lock the actuating lever 5 in a fixed position with respect to the cover 2 after the cover 2 has been released, an additional locking device can be provided according to the invention. This locking device is not specified in detail in the figures. The purpose of this locking device is to firmly hold the actuating lever 5 which, after the cover 2 has been raised, is released relative to the coupling shaft 10, at a predetermined angle with respect to the cover 2.

In the starting position of the load-break switch, the actuating lever 5 is in its vertical position corresponding to FIG. 1. In this position, the cover 2 can be opened in that the release element 17 is pressed downwards, thereby entailing the unlocking of the cover 2 by a movement of the locking arms 18, 19 in FIG. 1 in the direction of arrow B, after which the cover 2, preferably together with the actuating lever 5 can be pivoted about the pivot axis 6. This means that it is possible to access the interior of the load-break switch, for example in order to replace fuse elements if such are provided inside the housing below the cover 2. On the other hand, it is also possible to perform other manipulations when the cover is open, for example to produce connections to lines, etc. In the state according to FIG. 1, the load-break switch is without current, because the switch slide occupies the position shown in FIG. 2 in which the switch slide is held by the snap switch mechanism 3 in its position which produces the currentless state. As stated, in this position of the actuating lever, it is possible for the cover 2 to be opened, because the control element 15 has brought the blocking mechanism into a state in which the release element 17 can be actuated.

If the actuating lever 5 is pivoted out of the position according to FIG. 1 into the position according to FIG. 3, the coupling shaft 10 undergoes a rotational movement. The effect of the rotation of the coupling shaft 10 is that the spur wheel 12 triggers the snap switch mechanism 3 by engaging with a toothed portion of said snap switch mechanism. Triggering the snap switch mechanism 3 on the one hand has the effect that the control element 15 located on a part or shoulder of the snap switch mechanism 3 performs a movement, for example a rotational movement, due to the triggering of the control element, and consequently, due to engagement with the blocking element 16, the blocking element is moved in the direction of arrow B, i.e. along the axis of the load-break switch towards the release element 17, in order to stop the release element 17 from moving downwards. This procedure also prevents the locking arms 18, 19 from being able to release the cover. On the other hand, due to the triggering of the snap switch mechanism 3, the switch slide 7 is moved into a position in which the load-break switch is in the connected state, because the individual contacts 9 engage with the associated contact blades of the housing. Thus, the movement of the actuating lever from the position shown in FIG. 1 into the position shown in FIG. 3 entails a power flow which ensures both the blocking of the release element 17 and the displacement of the switch slide 7. The movement of the actuating lever 5 from the position shown in FIG. 3 back into the position shown in FIG. 1 produces a power flow in the opposite direction, i.e. the coupling shaft 10 is turned clockwise in FIG. 2, as a result of which the snap switch mechanism 3 is moved back into the starting position, while entraining the switch slide in a direction corresponding to arrow B, with simultaneous activation of the control element 15 and thus the release of the release element 17.

It should be noted that the mechanical connection between the control element 15 and the blocking element 18 can also be achieved by a cam sequential phase unit or by other means.

When, in the load-break switch according to the invention, the cover 2 together with the actuating lever 5 is to be pivoted about the axis 6 to open the cover, it is expedient to lock the actuating lever 5 with respect to the cover 2 in the vertical position shown in FIG. 1, i.e. while observing an angle of, for example, 90° with respect to the cover 2. For this purpose, a locking device can be provided which is not shown in detail and is activated and deactivated, for example, preferably as a function of the position of the locking arms 18, 19. This locking device is expediently activated when the locking arms 18, 19 are moved in the direction of arrow B by the release element 17 in order to lock the actuating lever 5 with respect to the cover 2 in the manner which has been mentioned. It is then possible for the cover 2 to be opened by the actuating lever 5 by swiveling about the axis 6. In this respect, it is then necessary for the actuating lever 5 to be released relative to the coupling shaft 10, which is possible in that the actuating lever 5 according to FIG. 2 is removed from the latches 13. When the cover is closed, the actuating lever 5 is positioned accordingly onto the latches 13 as soon as the cover is moved in an anti-clockwise direction towards an open state.

The blocking element 16 which can be adjusted in the axial direction of the load-break switch, i.e. in the direction of arrow B or opposite the direction of arrow B, is preferably in the form of a plate and, in a preferred embodiment, is provided with a colour, such as green. This blocking element 16 is located below a viewing window such that, with its green colour, it can be detected from outside through said viewing window when the actuating lever 5 occupies the vertical position shown in FIG. 1, i.e. when the load-break switch is ready to open the cover 2, whereas in the blocking position of the cover 2, namely when the actuating lever 5 is moved in the direction of the position according to FIG. 3, the blocking element can no longer be seen through the viewing window. This provides the operator with an indication allowing him to tell when the cover is ready to be opened.

The load-break switch according to the invention is configured in particular for high currents of, for example, 6,300 amps and it has an operator-independent operation, i.e. a snap switch mechanism 3 is used which contains an energy storing device for switching the contacts between the connected state and the disconnected state of the load-break switch.

A substantial advantage of the present invention is that the actuating lever or tilt lever has two functions, namely switching between the connected state and the disconnected state of the load-break switch on the one hand and opening the cover for replacing fuse elements or for manipulation inside the housing on the other hand, the tilt lever being firmly locked with the cover during the opening procedure in order to open the cover, so that it is not the cover itself but only the tilt lever which has to be grasped in order to open or close the cover. Compared to known load-break switches, this provides the advantage that it is possible to dispense with a rotary handle to trigger the snap switch mechanism 3 and instead, a single lever which has two functions, as mentioned, is provided.

In a preferred embodiment of the load-break switch, fuse elements are arranged in the housing on the lower side of the cover, so that the cover can be opened or closed in the described manner in order to replace said fuse elements.

A further feature provided in the preferred embodiment is that in the disconnected state in which the tilt lever is preferably vertical to the base of the housing, an additional release element has to be operated to open the cover and that the cover can only be opened while the release element is being operated. According to a further embodiment, a closing device can be activated, and in the disconnected state, after the release device has been actuated, the blocking device, preferably in the form of blocking arms, can be closed or fixed in the deactivated position. In this operational state, fuse elements can be replaced or other manipulations can be performed in the load-break switch when the cover is open.

Figure 10:
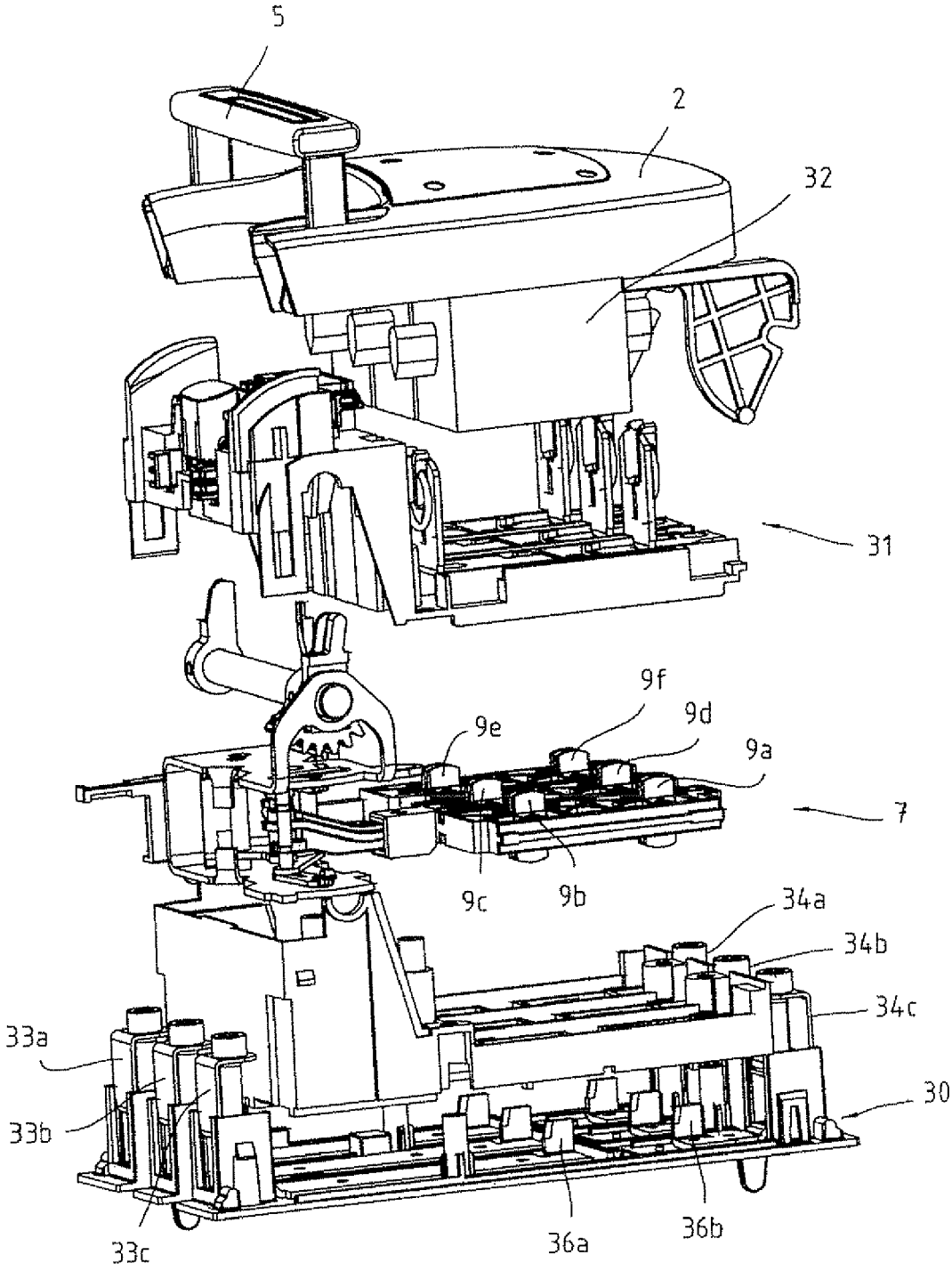
FIG. 10 is an exploded view of the load-break switch according to the invention.

FIG. 10 shows an exploded view of the load-break switch according to the invention without the surrounding housing to illustrate further details. As can be seen from FIG. 10, the load-break switch consists of a lower connection device 30, the switch slide 7 arranged above the connection device 30, and a receiving contact device 31 arranged above the switch slide 7. Thereafter follows the cover 2 with fuse elements, only one of which is denoted by reference numeral 32. The connection device 30 has on each end face connection contacts 33*a*, 33*h*, 33*c* and 34*a*, 34*h*, 34*c* respectively, of which some are input contacts and others are output contacts. Located between these pairs of contacts in the connection device 30 are conductors which are interrupted such that each conductor has in the interruption region a contact 36*a*, 36*b* which can be brought into contact with the associated contact pairs 9*a*, 9*b* of the switch slide 7 or can be disconnected from these contacts. This means that in the connected position, the switch slide 7 is in contact both with the contact tabs or contacts 36*a*, 36*b* of each pole of the connection device and with counter-contacts (not shown) which are configured in the receiving contact device 31, such that in the currentless state, the current path between each contact pair 33*a*, 34*a* and 33*b*, 34*b* and 33*c*, 34*c* respectively is interrupted and thus the fuse elements in the disconnected state are in a currentless state when the snap switch mechanism 3 has been activated accordingly. As a result, the connection device 30, the switch slide 7 and the receiving contact device 31 each have per pole two contacts which, in the disconnected state, are not contacted by the contacts of the switch slide 7.

The invention claimed is:

1. A load-break switch for the assembly on busbars, the load-break switch comprising:

a housing and a cover arranged pivotally thereon;

an actuating lever for switching between a current operation and a current interruption operation;

a control mechanism comprising a control element and a blocking element capable of freeing or blocking the movement of a release element as a function of a position of the actuating lever, a snap switch mechanism capable of triggering or interrupting an electrical connection between associated contacts connected to the control mechanism;

a locking device comprising a plate shaped body with two locking arms attached thereto, wherein the two locking arms are capable of engaging or disengaging the release element, and wherein the release element is arranged such that it is capable of being engaged with or disengaged from the cover.

2. The load-break switch of claim 1, wherein the actuating lever comprises a tilt lever, and wherein the pivot axis of the tilt lever is substantially parallel to the plane of the cover in the closed position thereof.

3. The load-break switch of claim 2, wherein the actuating lever is mechanically connected to a coupling shaft, wherein a transmission wheel is situated between the coupling shaft and the snap switch mechanism, and wherein the transmission wheel triggers the snap switch mechanism when the actuating lever is moved.

4. The load-break switch of claim 1, wherein the snap switch mechanism is coupled to a switch slide.

5. The load-break switch of claim 1, wherein the control element coupled to the snap switch mechanism is inserted into a control curve of the blocking element and moves the blocking element between two operating positions.

6. The load-break switch of claim 1, wherein the blocking element, depending on the movement of the control element, is capable of being moved to a position which allows the release element to move, and wherein the blocking element is capable of being moved to a different position which prevents the release element from moving.

7. The load-break switch of claim 1, wherein the blocking element has arms which can engage or disengage the release element.

8. The load-break switch of claim 1, wherein the blocking element is an indicator element.

9. The load-break switch of claim 1, wherein the blocking element comprises a plate-shaped body with arms attached thereto.

10. The load-break switch of claim 1, wherein the release element is pre-tensioned by a spring.

11. The load-break switch of claim 1, wherein fuse elements are accommodated in the housing.

* * * * *